US006377232B1

(12) United States Patent
Chevet et al.

(10) Patent No.: US 6,377,232 B1
(45) Date of Patent: Apr. 23, 2002

(54) METHOD OF COMPENSATING FOR THE DIFFERENCES IN PERSISTENCE OF THE PHOSPHORS IN AN IMAGE DISPLAY SCREEN

(75) Inventors: Jean-Claude Chevet, Betton; Didier Doyen, La Bouexière, both of (FR); Gérard Rilly, Unterkirnach (DE)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/211,241

(22) Filed: Dec. 14, 1998

(30) Foreign Application Priority Data

Dec. 15, 1997 (FR) ..... 97 15865

(51) Int. Cl.[7] ..... G09G 3/28

(52) U.S. Cl. ..... 345/63; 345/72; 345/76; 345/77; 345/210; 345/83; 345/60; 345/65

(58) Field of Search ..... 345/147, 148, 345/167, 89, 77, 63, 72, 76, 210

(56) References Cited

U.S. PATENT DOCUMENTS 3,874,370 A * 4/1975 Harris et al. ..... 128/2.06
4,424,467 A * 1/1984 Masuda et al. ..... 313/467
4,430,667 A * 2/1984 Gorga ..... 358/73
4,470,043 A * 9/1984 Sorensen et al. ..... 340/722
4,670,296 A * 6/1987 Akiba ..... 427/68
4,775,859 A * 10/1988 Starkey, IV et al. ..... 340/732
5,475,448 A * 12/1995 Saegusa ..... 348/797
5,757,349 A * 5/1998 Togashi ..... 345/91
5,936,621 A * 8/1999 Medin et al. ..... 345/213
6,025,818 A * 2/2000 Okano ..... 345/63

FOREIGN PATENT DOCUMENTS

EP 0720139 A2 7/1996 ..... G09G/3/22

OTHER PUBLICATIONS

Patent Abstracts of Japan, vol. 98, No. 2, Jan. 1998, & JP 09 274471A (Citizen Watch Co. Ltd.) Oct. 21, 1997.
Patent Abstracts of Japan, vol. 16, No. 236 (E–1210), May 20, 1992 & JP 04 048535 A (Hitachi Ltd.) Feb. 18, 1992.
French search report dated Jul. 13, 1998.

* cited by examiner

*Primary Examiner*—Matthew Luu
*Assistant Examiner*—Daniel J Chung
(74) *Attorney, Agent, or Firm*—Joseph S. Tripoli; Robert D. Shedd

(57) ABSTRACT

The present invention relates to a method of compensating for the differences in persistence of the phosphors in an image display screen consisting of cells arranged in lines and in columns, several adjacent cells being covered with different phosphors in order to form a pixel, the cells of one pixel being put either into an "off" state or into an "on" state for a time within one frame period depending on the grey level to be displayed. According to the method, at the pixel, the transitions between a first grey level and an adjacent second grey level are detected and if the transition is greater than a threshold the state of the cell covered with a persistent phosphor is forced to the second grey level before the end of the frame period. The invention applies especially to plasma panels.

9 Claims, 5 Drawing Sheets

METHOD OF COMPENSATING FOR THE DIFFERENCES IN PERSISTENCE OF THE PHOSPHORS IN AN IMAGE DISPLAY SCREEN

FIELD OF THE INVENTION

The present invention relates to a method of compensating for the differences in persistence of the phosphors in a colour image display screen. It also relates to a device for controlling the image display screen which implements the method.

BACKGROUND OF THE INVENTION

The present invention will be described with reference more particularly to display screens consisting of plasma panels which are either of the DC type with memory or of the AC type. However, it is obvious to those skilled in the art that the present invention may apply to other types of image display screens, more particularly colour image display screens, in which several adjacent cells are covered with different phosphors in order to form a colour pixel.

In a known manner, plasma panels are flat-screen display devices which operate on the principle of an electrical discharge in a gas. Plasma panels, or PDPs, generally have two insulating slabs defining a space filled with a gas mixture containing neon and xenon. The slabs support two or more arrays of crossed electrodes. Each intersection of electrodes defines a cell to which a small volume of gas corresponds. Electrical discharges may be generated in each volume of gas by applying suitable voltages to the corresponding two crossed electrodes. The crossed electrodes constitute the lines and columns, respectively, of the display screen. The number of line and column electrodes determines the definition of the screen. Each intersection of a column electrode with a line electrode will correspond to a video cell containing said volume of gas. In the case of a colour-type image display screen, each cell will be covered with a differently coloured phosphor, especially a red, green or blue phosphor, said cells being combined into triplets, each triplet forming a video pixel. Consequently, there are therefore three times as many column electrodes as there are pixels. On the other hand, the number of line electrodes is equal to the number of lines in the panel.

Given this matrix-type architecture, in order to excite a specific video cell and thus obtain a gas in the plasma state at discrete points, it is sufficient to apply a potential difference at the intersection of a line electrode with a column electrode. The ultraviolet rays coming from the excitation of the gas will thus bombard the red, green or blue phosphors and thus turn a red, green or blue cell on. In order to obtain the three—red, green and blue—components of a television-type image, the electrical conditions for the excitation of the cell remain the same. The three components are obtained solely by choosing three different phosphors. As a consequence, in order to achieve good colour homogeneity, it is important to make the proper choice of phosphors. Among the phosphors currently used, a phosphor of composition $Mn:Zn_2SiO_4$ is used for the green colour. Unlike the red and blue phosphors, the green phosphor has a persistence of about 28 milliseconds, whereas the persistence of the red phosphor is less than 5 milliseconds and that of the blue phosphor less than 1 millisecond. This persistence of the green phosphor must be put into the context of the frame period which is 20 milliseconds. Consequently, during a white-to-black time transition for example, namely when going from a white frame to a black frame, the green phosphor will continue to emit light for a time longer than one frame period after the transition, as shown in FIG. 1 in which:

curve a) shows the incident video signal;

curve b) shows the response of the red phosphor;

curve c) shows the response of the green phosphor;

curve d) shows the response of the blue phosphor and the bar e) shows diagrammatically the various grey levels.

This will result in an impression of green afterglow at this transition. The same will apply on going through a black-to-white transition which will result in an impression of magenta afterglow at the transition, as shown in FIG. 2 in which curves a), b), c) and d) and the bar e) have the same meaning as in FIG. 1. However, this persistence of the green will have no effect on homogeneous regions. This is because, since the grey level remains constant, the eye will not perceive any difference.

SUMMARY OF THE INVENTION

The object of the present invention is to provide a simple method making it possible to remedy these afterglow defects during large transitions, such as black-white or white-black transitions.

As a consequence, the subject of the present invention is a method of compensating for the differences in persistence of the phosphors in an image display screen consisting of cells arranged in lines and in columns, several adjacent cells being covered with different phosphors in order to form a pixel, the cells of one pixel being put either into an off state or into an on state for a time within one frame period depending on the grey level to be displayed, characterized in that, at the pixel, the transitions between a first grey level and an adjacent second grey level are detected and in that, if the transition is greater than a threshold, the state of the cell covered with a persistent phosphor is forced to the second grey level before the end of the frame period.

According to a preferred embodiment, the transition is detected by comparing the (n−1)th frame with the nth frame so as to detect the inter-frame differences greater than said threshold. Moreover, in the case of a plasma panel, each cell is in the off state or in the on state during n successive subscans of different duration distributed over a frame period. In this case, at least the last subscan is forced to the second grey level.

According to a preferred embodiment, when the difference between the nth frame and the (n−1)th frame is negative, the last subscan is forced to 0 and when the difference between the nth frame and the (n−1)th frame is positive, the last subscan is forced to 1.

According to the present invention, the transitions detected are the strong transitions, namely, at a pixel, the transitions between a white frame and a black frame or between a black frame and a white frame.

The present invention also relates to a device for controlling a display screen which implements the above method.

According to one embodiment of the present invention, the control device comprises a video processing circuit receiving, as input, a video signal and delivering video coding words, the processing circuit having as many elementary processing circuits as there are cells forming a pixel, said cells being covered with different phosphors, a video memory receiving the video coding words and transmitting column-control words to a circuit for supplying the columns of the display screen. It is characterized in that the processing circuit, corresponding to the cell covered with a persistent phosphor, includes means for detecting the transition between a first grey level and a second grey level and means for forcing the signal output to a value corresponding to the second grey level before the end of the frame period.

According to a preferred embodiment, the transition detection means include a circuit for storing the (n−1)th frame and a circuit which computes, for each pixel, the difference between the nth frame and the (n−1)th frame and sends a control signal when the difference is greater than a threshold. Moreover, each elementary processing circuit carries out a transcoding operation on the video signal in order to deliver the video control words. As a result, the means for forcing the signal consists of a circuit which changes the value of the video control words output by the transcoding circuit depending on the control signal sent by the circuit computing the difference between the nth frame and the (n−1)th frame.

According to an additional feature of the present invention, the image display screen is a plasma panel.

BRIEF DESCRIPTION OF THE DRAWINGS

Other features and advantages of the present invention will appear upon reading the detailed description given below of a preferred embodiment, this description referring to the appended drawings in which.

DESCRIPTION OF PREFERRED EMBODIMENTS

Figure 1A:
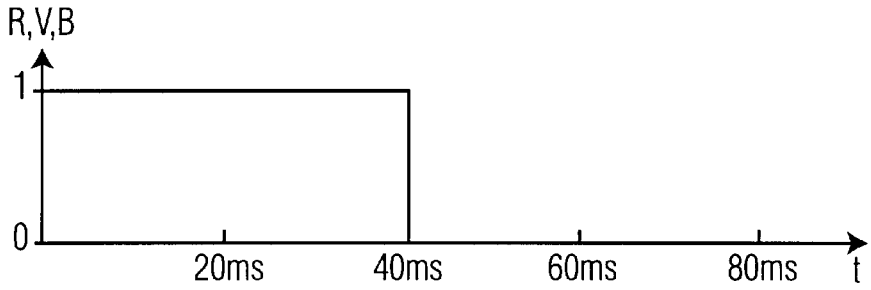
FIG. 1a PRIOR ART
FIG. 1 shows diagrammatically, for a pixel, the incident video signal and the response curves of the various phosphors during a white-black transition.
Figure 1B:
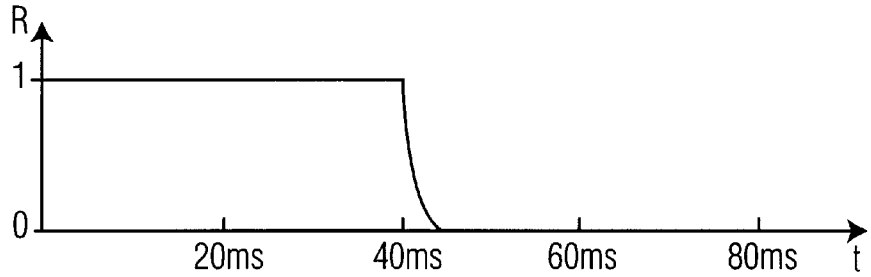
FIG. 1b PRIOR ART
Figure 1C:
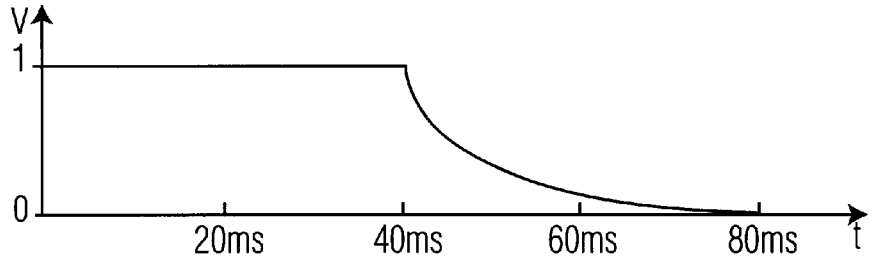
FIG. 1c PRIOR ART
Figure 1D:
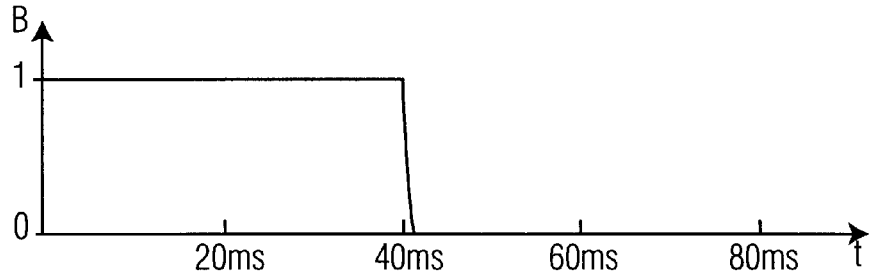
FIG. 1d PRIOR ART
Figure 1E:
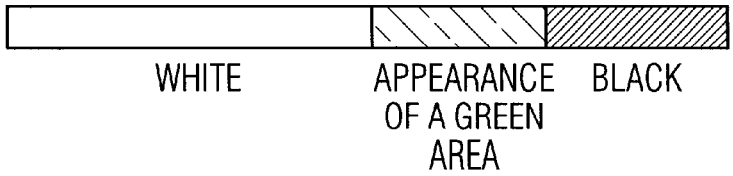
FIG. 1e PRIOR ART
Figure 2A:
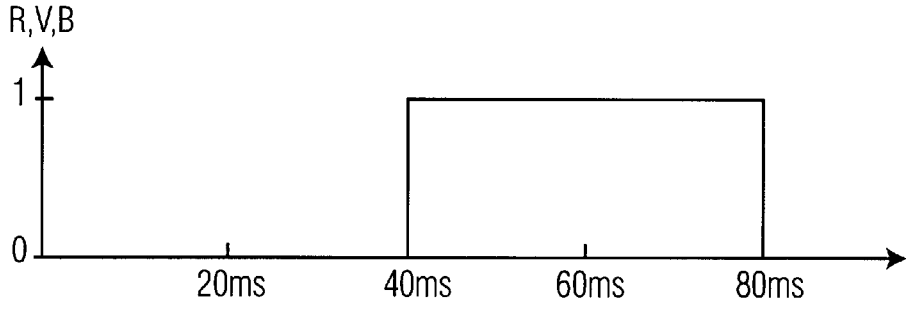
FIG. 2a PRIOR ART
FIG. 2, already described, shows the same curves as those in FIG. 1 during a black-white transition.
Figure 2B:
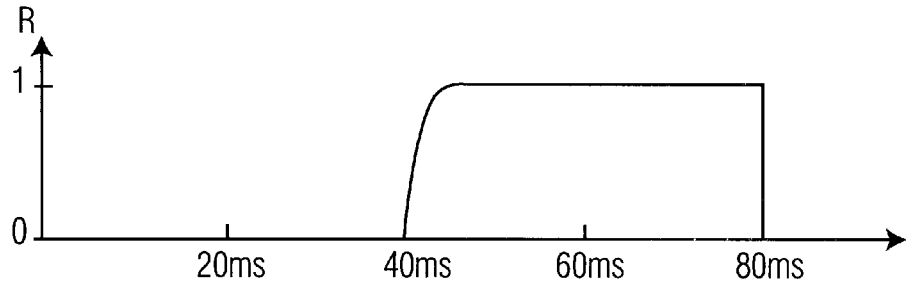
FIG. 2b PRIOR ART
Figure 2C:
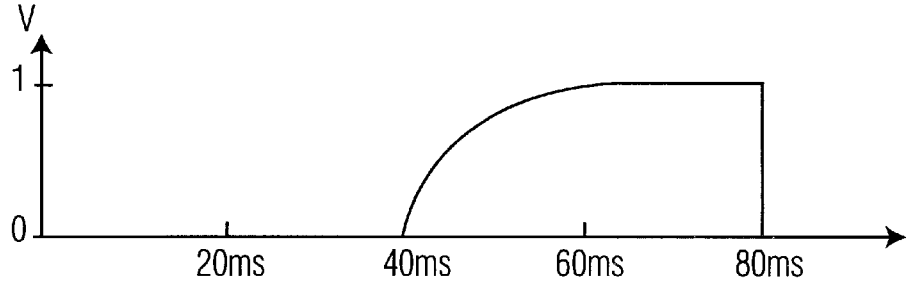
FIG. 2c PRIOR ART
Figure 2D:
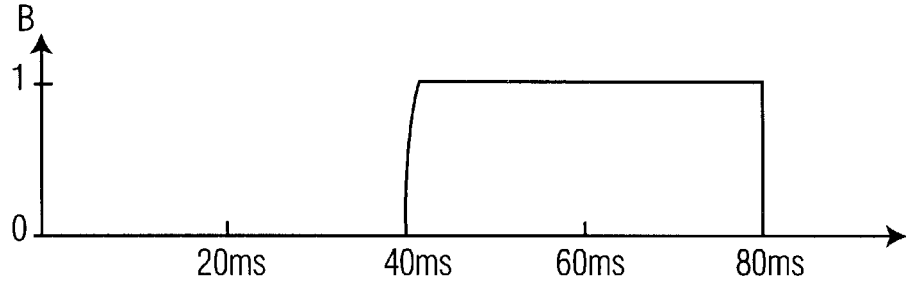
FIG. 2d PRIOR ART
Figure 2E:
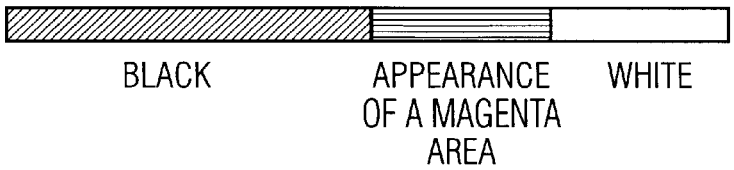
FIG. 2e PRIOR ART
Figure 3A:
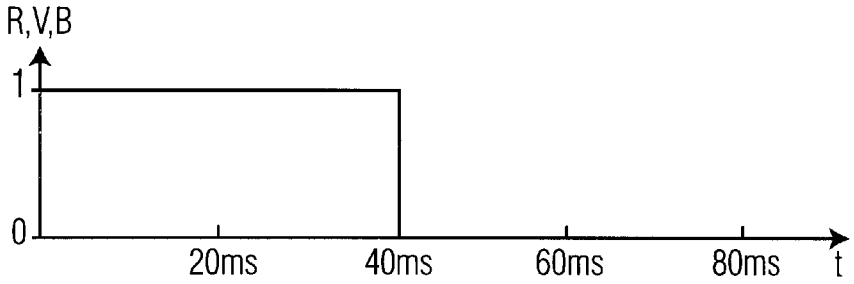
FIG. 3 shows curves identical to those in FIG. 1 during a white-black transition employing the method of the present invention.
Figure 3B:
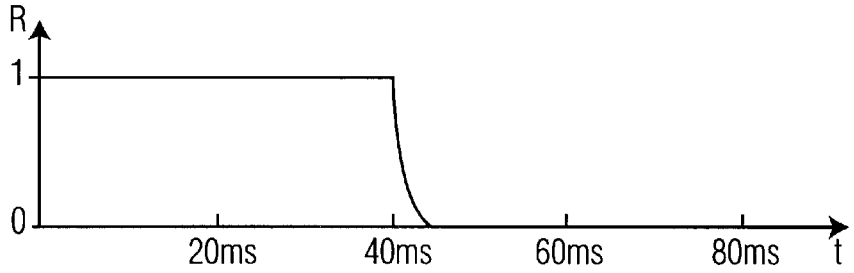
Figure 3C:
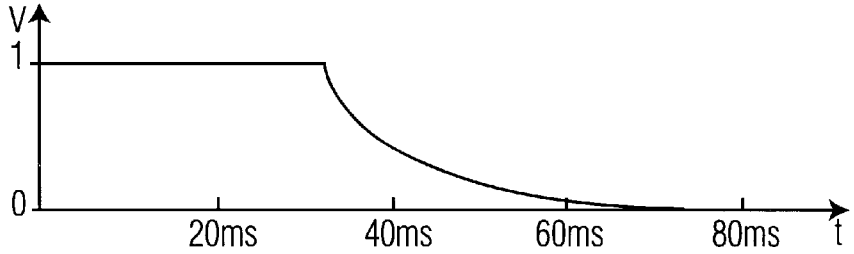
Figure 3D:
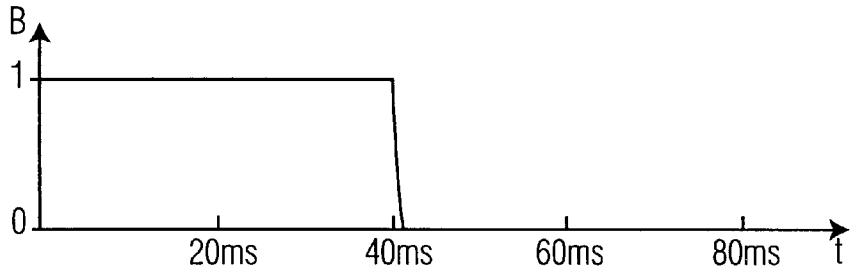
Figure 3E:
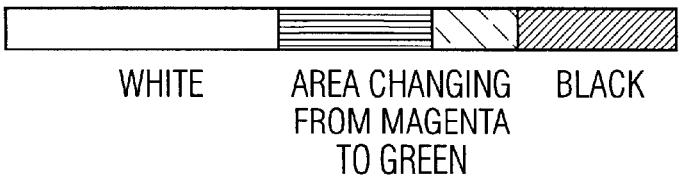
Figure 4A:
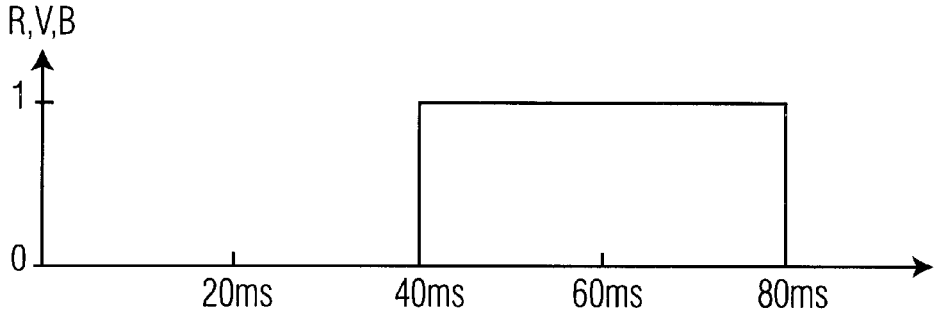
FIG. 4 shows curves identical to those in FIG. 3 during a black-white transition.
Figure 4B:
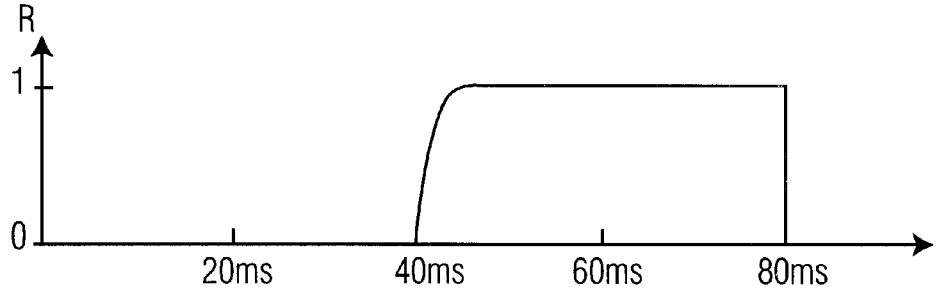
Figure 4C:
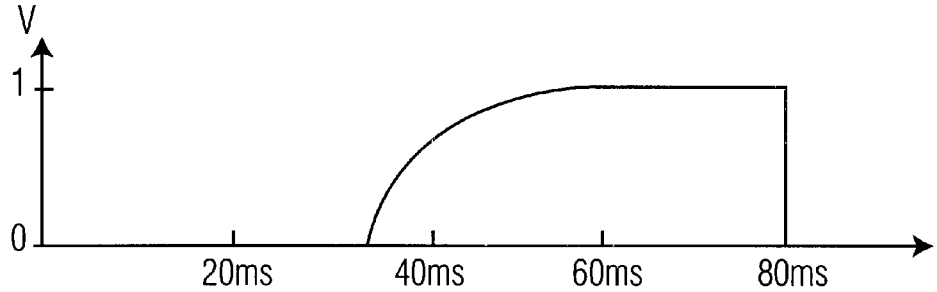
Figure 4D:
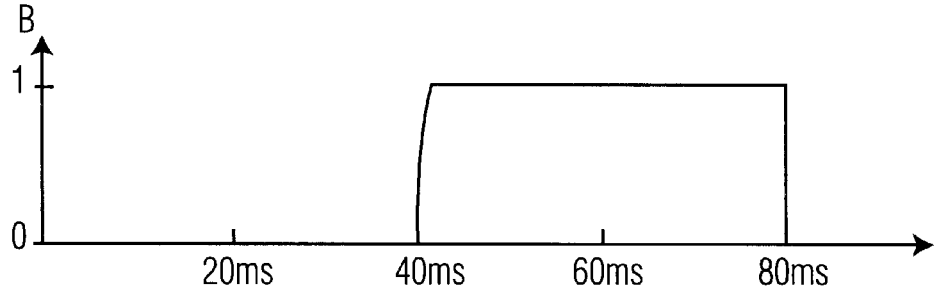
Figure 4E:
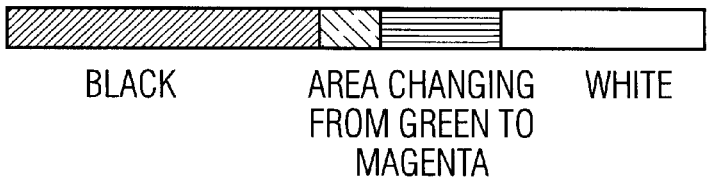

In order to simplify the description, identical elements in the figures bear the same references.

The present invention will be described with reference to a plasma panel. In order for it to be more clearly understood how it operates, the methods of addressing a plasma panel will first of all be recalled.

An elementary cell of a plasma panel can only be in two states, namely the off state and the on state. It is known that, since an analogue modulation in the amount of light emitted by a pixel is not possible, the generation of half-tones or grey levels takes place by time-domain modulation of the emission time of the pixel over the frame period T. This frame period consists of as many multiple subperiods ($T_0$, $2T_0$, . . . , $2^{n-1}T_0$) of a value $T_0$ as there are coding bits in the video signal (nbit). On the basis of the n subscans, it is possible, by combination, to construct $2^n$ different grey levels of linearly distributed brightness.

The method of generating the grey levels by time-domain modulation therefore requires access to each pixel (or cell) during the period of one frame, which means storing the video information during the frame. The screen-addressing sequence begins by selecting a complete line by means of two high-voltage pulses that are generated by an amplifier and applied to the electrode via the line-supply circuit. The first pulse erases the entire line and the second prepositions the recording. The pixels of the selected line are addressed simultaneously by a signal from the column-supply circuits. These circuits are preloaded with information from an image memory and address the column electrodes either with a high-voltage signal, which masks the write pulse, or with an earth signal, depending on the preloaded video information. This information consists of only one of the pixel coding bits, the other bits being processed at other times during the frame period. The set of bits is called hereafter the column-control word. The state of the pixel is therefore contingent on the difference in the voltages applied to the terminals of its cell. This state—off or on—is then maintained by an alternating signal common to all the cells of the panel until this line is addressed again (memory effect).

Scanning a plasma panel requires, in all, n times for access to each pixel during the period of one frame. Scanning the panel therefore quickly becomes complicated since each line of the screen must be addressed n times, each time according to the procedure described above. The relationship linking the various parameters for addressing a plasma panel, the number $N_1$ of lines of the displayed image, the addressing time tad for a line and the number n of scans of the screen with the image period T is as follows:

$$T \geqq n.N_1.t_{ad.}$$

The complete scan of a plasma panel therefore consists of n sequences of addressing $N_1$ lines. n subscans are defined, each of these subscans being dedicated to the processing of one of the coding bits of the video signal or, more precisely, one of the column-control words.

According to the present invention, in order to remedy the afterglow effects due to certain persistent phosphors, especially to green phosphors, coding on n subscans is used in order to force at least the last coding bit of the video signal to a level corresponding to the second grey level, namely either to the white level or to the black level, depending on the type of transition detected.

The principle of time-domain modulation of the grey level as explained above involves distributing the information to be transmitted over the entire duration, namely over 20 milliseconds. In a white-black transition, the cell has been excited before the transition (white area) and will not be excited after the transition (black area). This is shown by curve a in FIG. 3, in which the incident RGB video signal is at level 1 corresponding to the white area and then, after 40 milliseconds, switches to level 0 corresponding to a black area. In the present invention, the red and blue phosphors have a rapid response time, as may be seen in curves b and d. However, since the green phosphor has a much longer persistence, according to the present invention, in order to prevent the afterglow effect, the transmitted signal level is modified by making the transmitted video information black at the end of the white frame, i.e. just before the transition, as shown in curve c in FIG. 3. Consequently, the green afterglow therefore takes place to a large extent over the white frame, thereby maintaining a white level. On the other hand, during the black frame, the remainder of the green afterglow is greatly reduced, hence a large reduction in the appearance of the green area. This is shown at e in FIG. 3, the colour gradually changing from magenta to green during the transition.

In the case of a black-white transition, as shown in FIG. 4, the operation of modifying the video signal will be the reverse. In this case, as shown in curve c, at least the last subscan of the black frame for the green phosphor is forced to 1, by anticipating the black-white transition for this phosphor. Consequently, an area switching from green to magenta in an attenuated manner is observed, as shown at e in FIG. 4.

In the context of the present invention, a black-white or white-black transition will be detected between the current frame and the preceding frame, the correction being made on the preceding frame.

Figure 5:
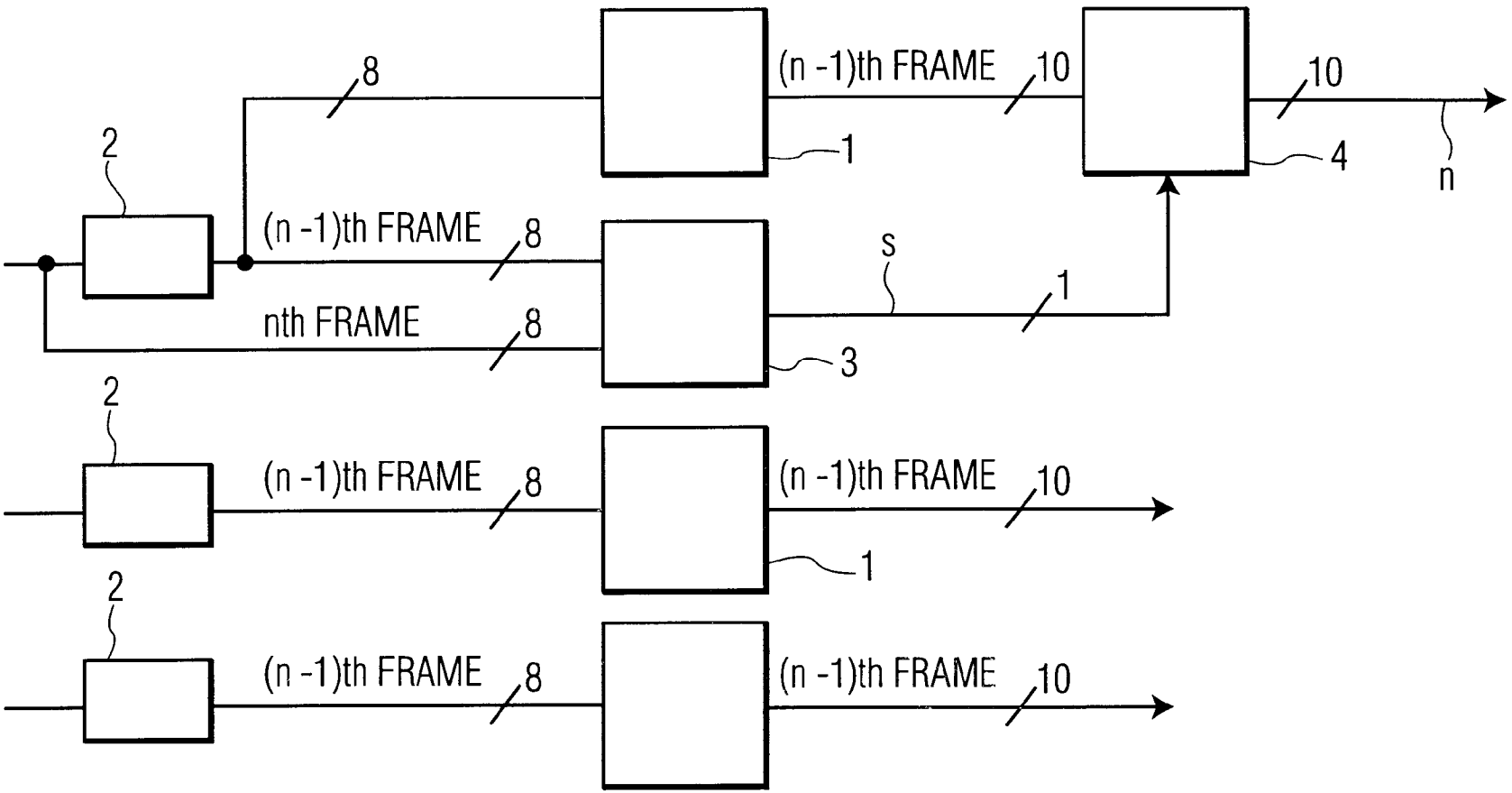
FIG. 5 shows a block diagram of a video processing circuit included in a control device of a plasma panel comprising circuits for implementing the present invention.

The modification made to the video processing circuit for implementing the present invention will now be explained. As shown in FIG. 5, the video processing circuit used in the control device for a plasma panel has three inputs for the video signal split into green, red and blue, the inputs being termed G, R and B, respectively. The current frame (nth frame) for each G R B signal is sent to an image memory 2, allowing the previous frame or (n−1)th frame to be processed, and an elementary processing circuit 1, which carries out the transcoding of the video information in n subscans, in a manner known to those skilled in. the art. The video code words thus obtained are sent to an image memory, not shown, provided before the column-supply circuit of a plasma panel. According to the present invention, the elementary processing circuit for the green signal, corresponding to a persistent phosphor, has been modified so as to be able to force the bit from at least the last subscan to 0 or to 1 depending on the transition detected. As shown in FIG. 5, the G signal is sent to a circuit 2 for storing the previous frame, making it possible to obtain as output the (n−1)th frame. The nth frame and the (n−1)th frame are sent to the two inputs of a circuit 3 which computes the difference between the two frames and detects whether this difference is greater than a threshold so as to send a control signal S which is used to force at least the bit of the last subscan to 1 or to 0. To do this, the output of the circuit 1 is sent to a circuit 4 for modifying the video information, the operation of which is controlled by the signal S. If there is no signal S, the video coding word from the circuit 1 is obtained as output. If a threshold is detected, a coding word n' is obtained as output, this being modified as explained above.

A specific example of how the principle described above is applied will now be described.

The present characteristics of a plasma panel allow 10 subscans of each of the lines to be made, which amounts to coding the 256 levels of a video signal over 10 bits. By way of example, the 10-bit code may be as follows:

1 2 4 8 16(1) 16(2) 32 48 64(1) 64(2).

According to the addressing method described above, the video information coded over 10 bits will be time-domain modulated and distributed over the 20 milliseconds corresponding to one frame. The sequencing of the subscans may be as follows:

64(2) 48 16(2) 8 2 1 4 16(1) 32 64(1).

The 64(1) subscan is carried out last and therefore corresponds to the last subscan of the current frame before the first subscan of the next frame.

According to the present invention, the first operation consists in detecting the differences between the (n−1)th frame and the nth frame that are greater than a threshold defining the strong transitions to be corrected. By way of example, the detection threshold may be fixed at 128. Taking into account the mode of coding given above, this amounts to forcing the 64(1) bit to 0 in the case of the low value of the transition and to 1 in the case of the high value. For the pixels to be corrected, namely the pixels covered with a green phosphor in the embodiment shown, the content of the 64(1) bit will be modified in the following manner:

during a strong negative transition (namely, when the level of the nth frame is very much lower than the level of the (n−1)th frame, (n)−(n−1) <128), this negative transition must be anticipated by forcing the 64(1) bit of the (n−1)th frame to 0;

during a strong positive transition (namely, when the level of the nth frame is very much higher than the level of the (n−1)th frame), this positive transition must be anticipated by forcing the 64(1) bit of the (n−1)th frame to 1.

The present invention has been described by making a correction to a subscan, which amounts to anticipating the detected transition by 5 milliseconds when the last subscan corresponds to the 64(1) bit. However, it is obvious to those skilled in the art that the number of subscans may be different.

What is claimed is:

1. Method for compensating the differences in persistence of the phosphors in an image display screen consisting of cells arranged in lines and in columns, several adjacent cells being covered with different phosphors in order to form a pixel, the cells of one pixel being either into an "off" state or into an "on" state for a time within one frame period depending on the grey level to be displayed, said method comprising the steps of:

detecting, at the pixel level, high transitions between a first grey level and an adjacent grey level, by comparing, at each pixel, the (n−1) frame with the nth frame so as to detect inter-frame differences and, if the transition is greater than a threshold, forcing, during at least a last subscan, the value of the grey level of the cell covered with a persistent phosphor to the value of the second grey level before the end of the frame period.

2. Method according to claim 1, wherein the transition is detected by comparing, at each pixel, the (n−1)th frame with the nth frame so as to detect the inter-frame differences greater than said threshold.

3. Method according to claim 1, wherein each cell is in the "off" state or in the "on" state during n successive subscans of different durations distributed over a frame period.

4. Method according to claim 3, wherein at least the last subscan is forced to the second grey level.

5. Method for compensating the differences in persistence of the phosphors in an image display screen consisting of cells arranged in lines and in columns, several adjacent cells being covered with different phosphors in order to form a pixel, the cells of one pixel being put either into an "off" state or into an "on" state for a time within one frame period depending on the grey level to be displayed, said method comprising the steps of:

detecting, at the pixel level, the transitions between a first grey level and an adjacent second grey level; and if the transition is greater than a threshold, forcing the state of the cell covered with a persistent phosphor to the second grey level before the end of the frame period; wherein the transition is detected by comparing, at each pixel, the (n−1)th frame with the nth frame so as to detect the inter-frame differences greater than said threshold;

each cell is in the "off" state or in the "on" state during n successive subscans of different durations distributed over a frame period;

at least the last subscan is forced to the second grey level; and when the difference at each pixel between the nth frame and the (n−1)th frame is negative, the last subscan is forced to zero and when the difference between the nth frame and the (n−1)th frame is positive, the last subscan is forced to 1.

6. Method according to claim 2, wherein at a pixel level, the (n−1)th frame is a white or black frame and the nth frame is a black or white frame, respectively.

7. Method according to claim 1, wherein the phosphors are red, green and blue phosphors, the most persistent phosphor being the green phosphor.

8. Device for controlling an image display screen which implements the method according to claim 1, the device comprising a video processing circuit receiving, as input, a video signal and delivering video coding words, the processing circuit having as many elementary processing circuits as there are cells forming a pixel, said cells being covered with different phosphors, a video memory receiving the video coding words and transmitting column-control words to a circuit for supplying the columns of the display screen, wherein the processing circuit, corresponding to the cell covered with a persistent phosphor, includes means for detecting the transition between a first grey level and a second grey level before the end of the frame period; said transition detection means include a circuit for storing the (n−1)th frame and a circuit which computes, at each pixel, the difference between the nth frame and the (n−1)th frame and sends a control signal when the difference is greater than a threshold, during at least a last subscan;

each elementary processing circuit carrying out a transcoding operation on the video signal in order to deliver the video control words; and further comprising means for forcing the signal which consists of a circuit which changes the value of the video control words output by the transcoding circuit depending on the control signal sent by the circuit computing the difference between the nth frame and the (n−1) frame at each pixel.

9. Device according to claim 8, wherein the image display screen is a plasma panel.

* * * * *